US008676074B2

(12) United States Patent
Tombs et al.

(10) Patent No.: US 8,676,074 B2
(45) **Date of Patent: *Mar. 18, 2014**

(54) METHOD FOR PROVIDING RATIO MODULATED PRINTING WITH DISCHARGE AREA DEVELOPMENT

(75) Inventors: Thomas Nathaniel Tombs, Rochester, NY (US); Donald Saul Rimai, Webster, NY (US); William Yurich Fowlkes, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 269 days.

This patent is subject to a terminal disclaimer.

(21) Appl. No.: 13/077,543

(22) Filed: Mar. 31, 2011

(65) Prior Publication Data

US 2012/0251146 A1 Oct. 4, 2012

(51) Int. Cl.
*G03G 15/01* (2006.01)
*G03G 15/06* (2006.01)

(52) U.S. Cl.
USPC ..... 399/54; 399/55

(58) Field of Classification Search
USPC ..... 399/54, 55
See application file for complete search history.

(56) References Cited

U.S. PATENT DOCUMENTS

| | | | | |
|---|---|---|---|---|
| 3,724,422 A | | 4/1973 | Latone et al. | |
| 3,927,641 A | | 12/1975 | Handa | |
| 4,041,903 A | | 8/1977 | Katakura et al. | |
| 4,771,314 A | * | 9/1988 | Parker et al. | 399/232 |
| 4,847,655 A | * | 7/1989 | Parker et al. | 399/232 |
| 4,879,194 A | * | 11/1989 | Snelling | 430/53 |
| 5,234,783 A | | 8/1993 | Ng | |
| 5,905,012 A | | 5/1999 | De Meutter et al. | |
| 5,926,679 A | * | 7/1999 | May et al. | 430/44.1 |
| 6,608,987 B2 | | 8/2003 | Bartscher et al. | |
| 6,768,880 B2 | * | 7/2004 | Iida et al. | 399/55 |
| 6,880,463 B2 | | 4/2005 | DeMeulemeester et al. | |

(Continued)

FOREIGN PATENT DOCUMENTS

| | | |
|---|---|---|
| JP | 62-049377 | 3/1987 |
| JP | 2000-231279 | 8/2000 |
| JP | 2005-189719 | 7/2005 |
| JP | 2007-328061 | 12/2007 |

OTHER PUBLICATIONS

IS & T's 1997 International Conference on Digital Printing Technologies, UV-cured Toners for Printing and Coating on Paper-like Substrates, pp. 168-172, Detlef Schuzle-Hagenest, Micheal Huber, Saskia Udding-Louwrier and Paul H.G. Binda.

*Primary Examiner* — G. M. Hyder
(74) *Attorney, Agent, or Firm* — David A. Novais

(57) ABSTRACT

Methods for printing are provided. In one aspect, the method includes providing a primary imaging member having engine pixel locations with a ratio modulated difference of potentials, establishing a first development difference of potential to form a first net development difference of potential between the first development difference of potential and the engine pixel location and providing a first charged toner such that the first toner develops at the engine pixel location according to the first net development difference of potential. Establishing a second development difference of potential that is greater than the first difference of potential proximate the engine pixel location such that a determined amount of second toner develops at the engine pixel locations. Wherein the range of first toner potentials is such that a determined range of ratios of first toner amounts and the determined second toner amount provide ratio modulated differences of potential.

23 Claims, 14 Drawing Sheets

(56) References Cited

U.S. PATENT DOCUMENTS

| | | | | |
|---|---|---|---|---|
| 7,016,621 | B1 | 3/2006 | Ng | |
| 7,120,379 | B2 | 10/2006 | Eck et al. | |
| 7,389,073 | B2 | 6/2008 | Kamar et al. | |
| 2002/0168200 | A1 | 11/2002 | Stelter et al. | |
| 2003/0007814 | A1 * | 1/2003 | Richards | 399/341 |
| 2009/0162113 | A1 | 6/2009 | Solcz et al. | |
| 2012/0195614 | A1 * | 8/2012 | Fowlkes | 399/55 |
| 2012/0195615 | A1 * | 8/2012 | Fowlkes | 399/55 |

* cited by examiner

METHOD FOR PROVIDING RATIO MODULATED PRINTING WITH DISCHARGE AREA DEVELOPMENT

CROSS REFERENCE TO RELATED APPLICATIONS

This application relates to commonly assigned, copending U.S. application Ser. No. 13/077,496, filed Mar. 31, 2011, entitled: "DUAL TONER PRINTING WITH DISCHARGE AREA DEVELOPMENT"; U.S. application Ser. No. 13/077,474, filed Mar. 31, 2011, entitled: "DUAL TONER PRINTING WITH CHARGE AREA DEVELOPMENT"; U.S. application Ser. No. 13/077,522, filed Mar. 31, 2011, entitled: "RATIO MODULATED PRINTING WITH CHARGE AREA DEVELOPMENT"; U.S. application Ser. No. 13/018,188, filed Jan. 31, 2011, entitled: "ENHANCEMENT OF DISCHARGED AREA DEVELOPED TONER LAYER"; U.S. application Ser. No. 13/018,158, filed Jan. 31, 2011, entitled: "ENHANCEMENT OF CHARGE AREA DEVELOPED TONER LAYER"; U.S. application Ser. No. 13/018,172, filed Jan. 31, 2011, entitled: "BALANCING DISCHARGE AREA DEVELOPED AND TRANSFERRED TONER"; U.S. application Ser. No. 13/018,148, filed Jan. 31, 2011, entitled: "BALANCING CHARGE AREA DEVELOPED AND TRANSFERRED TONER"; U.S. application Ser. No. 13/018,183, filed Jan. 31, 2011, entitled: "PRINTER WITH DISCHARGE AREA DEVELOPED TONER BALANCING"; and U.S. application Ser. No. 13/018,136, filed Jan. 31, 2011, entitled: "PRINTER WITH CHARGE AREA DEVELOPED TONER BALANCING"; each of which is hereby incorporated by reference.

FIELD OF THE INVENTION

This invention pertains to the field of electrophotographic printing.

BACKGROUND OF THE INVENTION

Color electrophotographic printers provide full color images by building up and sequentially transferring individual color separation toner images in registration onto a receiver and fusing the toner and receiver. Specific color outcomes are achieved in such printers because controlled ratios of differently colored toners are applied in combination to create appearance of a desired color at specific locations on a receiver. Similarly, as is described in U.S. Patent Publication Number: US20090286177A1, entitled "Adjustable Gloss Document Printing" different toners such as high viscosity toners can be used in combination with lower viscosity toners to allow a user to obtain an adjustable gloss. The gloss is made adjustable by controlling the ratio of the two types of toner in the combination.

It will be appreciated that many other desirable printing outcomes can be achieved using ratio controlled combinations of toners. However, a central limitation on the use of multiple different toner types in electrophotographic printers and methods is that electrophotographic printing modules of the type that form the individual toner images can be large, complicated and expensive. Further, it is difficult to ensure registration of the printing modules with the transfer systems and receivers in a digital printer and such difficulties increase with each additional printing module that is to be incorporated into a printer.

Accordingly, printers are typically designed to provide a limited number of such electrophotographic printing modules. For example, the Nexpress 2100 and subsequent models provide a tandem arrangement of five printing modules. During printing of color image four of these tandem printing modules apply different ones of four toners, each supplying one of the four primary subtractive colors, while a fifth printing module is used to apply custom colors, clear overcoats and other different types of toner to the formed color toner image. The fifth printing module can be used add toners to the color toner image in precise ratios relative to the toners that have previously been applied. While this can be done in a highly effective and commercially viable manner, there remains a need in the art for methods that enable toner images to be formed for use in making an electrophotographic print that include a greater number of different toners than the limited number that are currently available and that can provide such toners in controlled registration and in a manner that can be adjusted on a picture element by picture element basis.

In one alternative, U.S. Pat. No. 5,926,679, issued to May, et al., discloses that a clear (non-marking) toner layer can be laid down on a photoconductive member (e.g., imaging cylinder) prior to forming a marking particle toner image thereon, and that a clear toner layer can be laid down as a last layer on top of a marking particle toner image prior to transfer of the image to an intermediate transfer member (e.g., blanket cylinder). It is also disclosed that a clear toner layer can be laid down on a blanket cylinder prior to transferring a marking particle toner image from a photoconductive member. In one aspect of this patent, a non-imagewise clear toner layer is bias-developed on to an intermediate transfer member using a uniform charger and a non-marking toner development station. A first monocolor toner image corresponding to one of the marking toners is transferred to the ITM (on top of the clear toner) from a primary imaging member which may be a roller or a web but is preferably a roller. Subsequently, a second monocolor toner image corresponding to another of the marking toners is transferred to the ITM (on top of and in registration with the first toner image) and so forth until a completed multicolor image stack has been transferred on top of the clear toner on the ITM. The ITM is then positioned at a sintering exposure station; where a sintering radiation is turned on to sinter the toner image for a predetermined length of time.

However, while this approach can be effective and can provide a commercially viable solution, this approach requires an additional transfer step for each toner that is applied which, in turn, reduces machine productivity.

Accordingly, what is needed in the art are printers and printing methods that enable an increase in the opportunities to use the features of ratio controlled combinations of toners without compromising the efficiency and the accuracy of registration with which each of the toners can be provided.

SUMMARY OF THE INVENTION

Methods for printing are provided. In one aspect, the method includes, providing a primary imaging member having engine pixel locations with a range of ratio modulated differences of potentials of a first polarity at each engine pixel location, establishing a first development difference of potential relative to a ground, to form a first net development difference of potential between the first development difference of potential and the individual engine pixel locations ratio modulated potential and providing a first charged toner of the first polarity such that the first toner develops at the individual engine pixel locations according to the first net development difference of potential at individual engine pixel locations. A second development difference of potential is established relative to ground that is greater than the first difference of potential proximate to the engine pixel location to form, a second net development difference of potential between the second development difference of potential, the first toner potential at the engine pixel location and the ratio modulated difference of potential at the engine pixel location and a second charged toner is provided having a polarity that is the same as a polarity of the first charged toner such that such that the second toner develops at the engine pixel location according to the second net development difference of potential. The range of first toner that can be developed at an engine pixel location is within a range of ratio modulated differences of potential and wherein the second development difference of potential is determined such that an amount of second toner potential developed with the first toner potential at an engine pixel location in response to a ratio modulated difference of potential allows any of a determined range of ratios of first toner amounts and second toner amounts to be provided at the engine pixel locations.

DETAILED DESCRIPTION OF THE DRAWINGS

Figure 9:
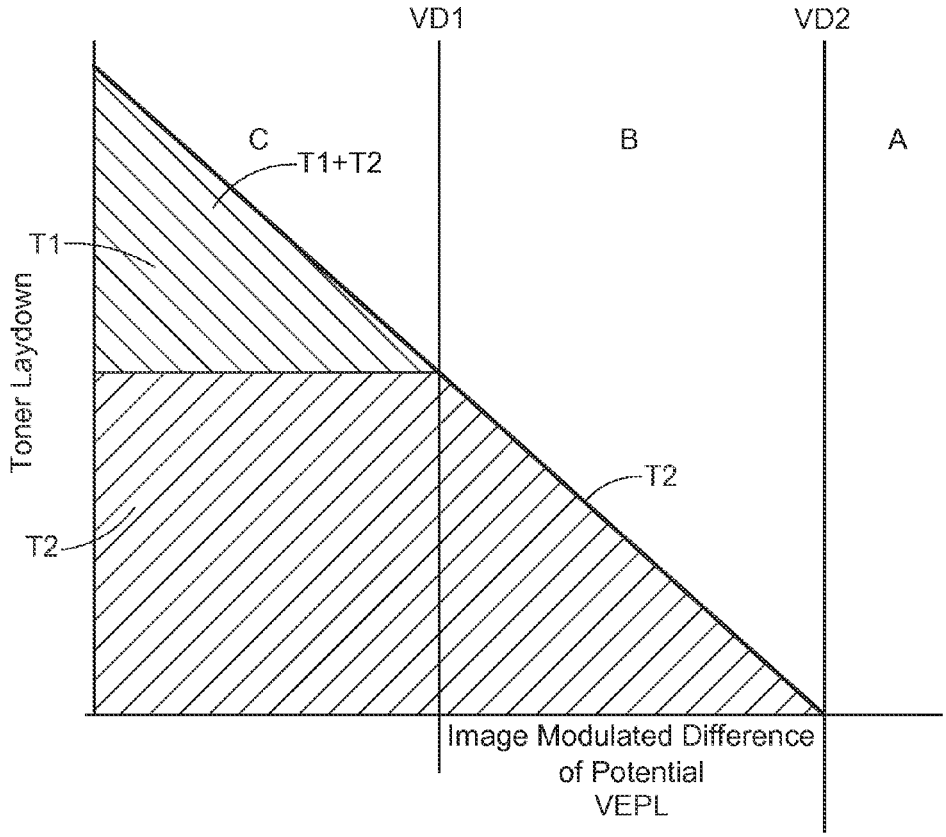

FIG. 9 provides one model of a toner delivery curve.

DETAILED DESCRIPTION OF THE INVENTION

Figure 1:
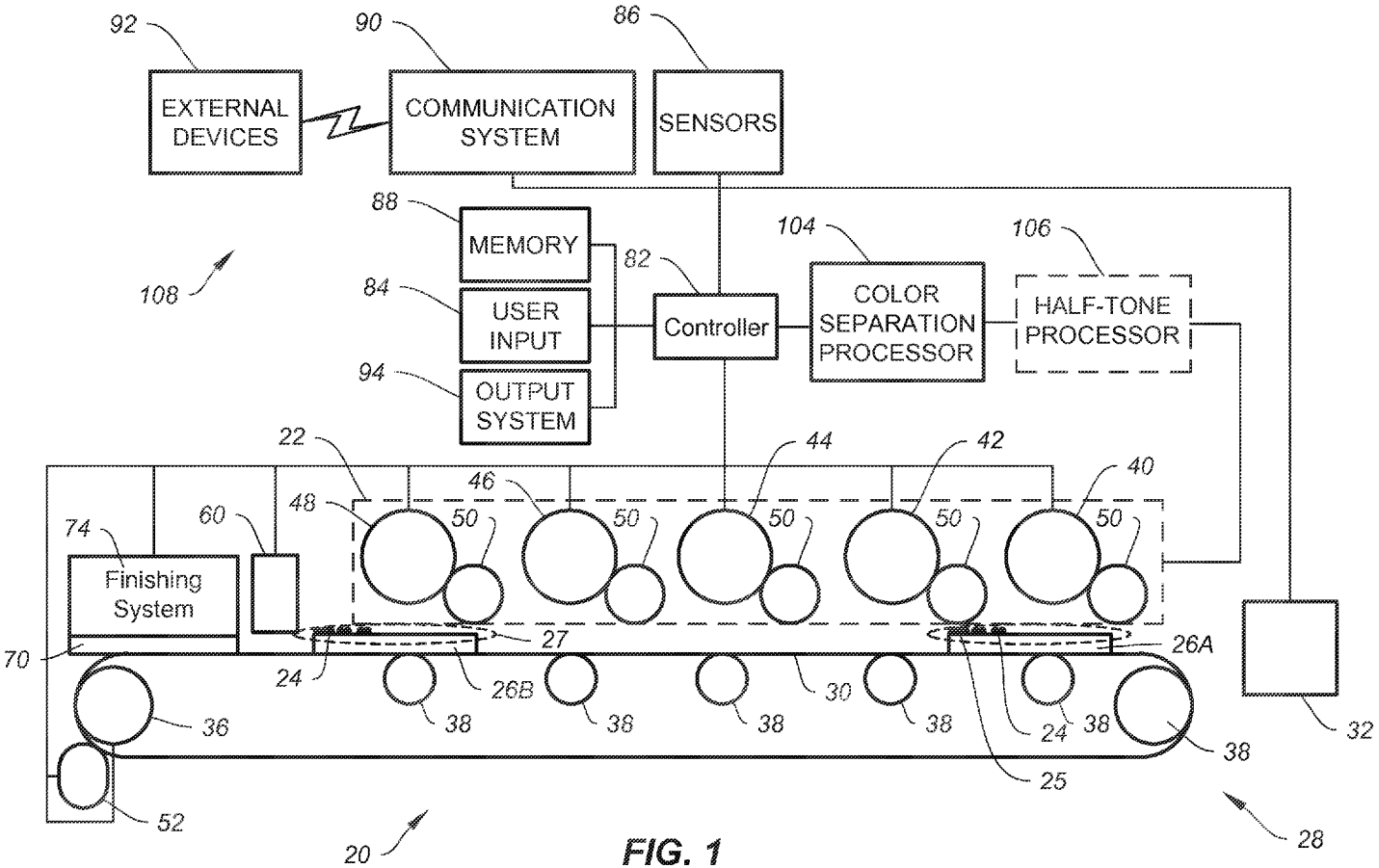
FIG. 1 shows a system level illustration of one embodiment of an electrophotographic printer.
Figure 2:
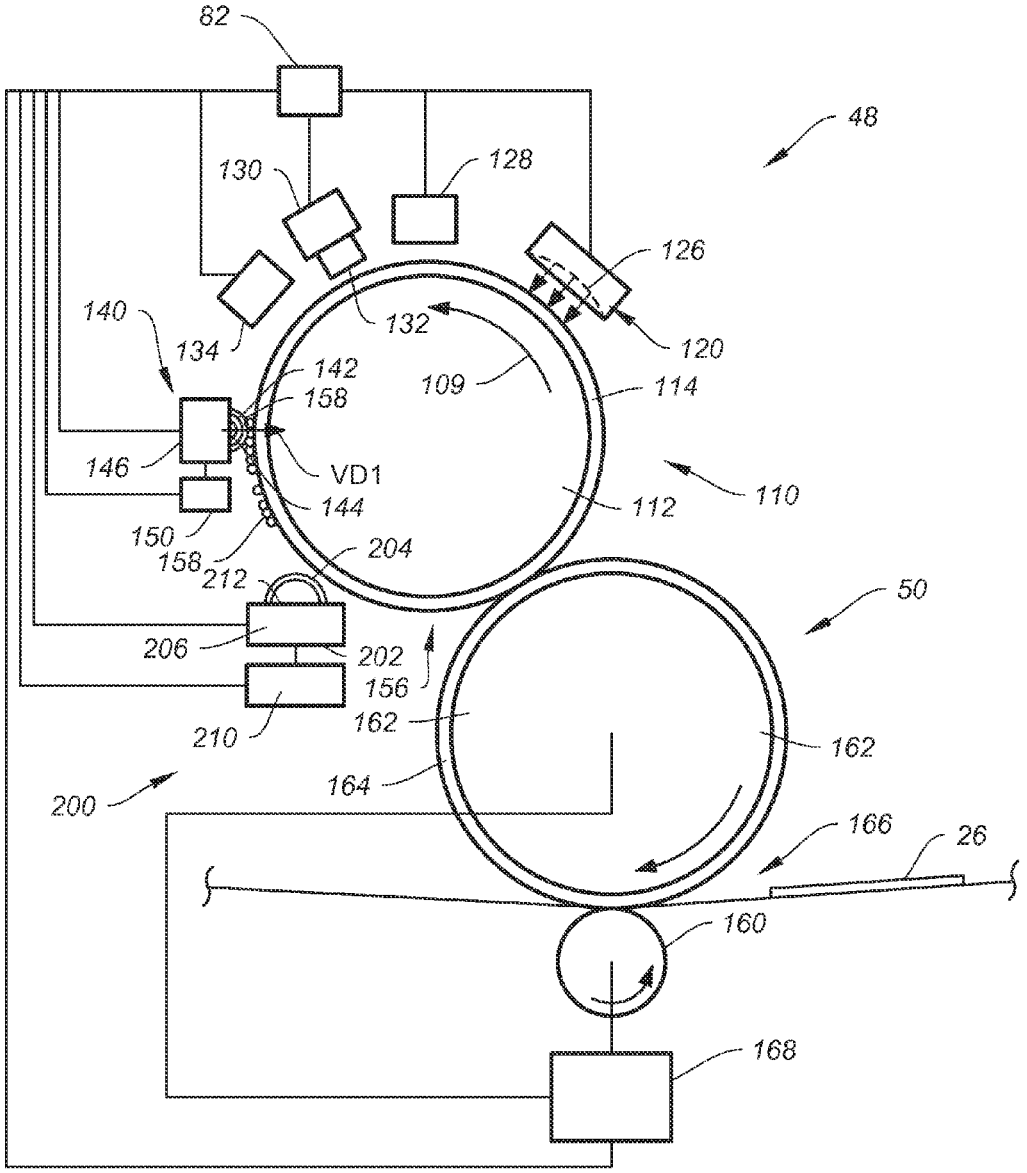
FIG. 2 illustrates one embodiment of a printing module having a toner co-development system during first development.

FIG. 1 is a system level illustration of a printer 20. In the embodiment of FIG. 1, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26 to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Figure 3:
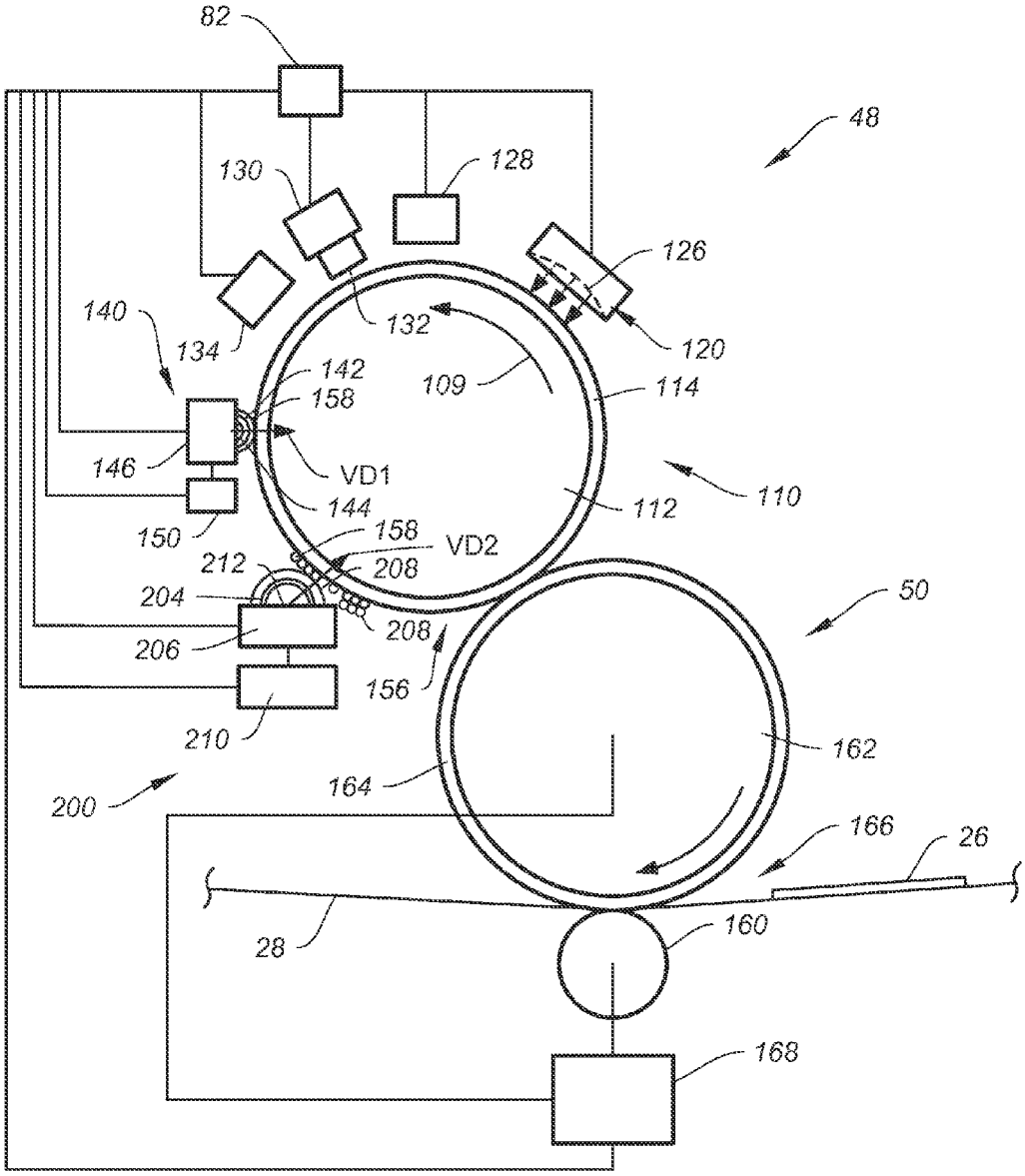
FIG. 3 illustrates the embodiment of FIG. 2 during second development.

Print engine 22 has one or more printing modules, shown in FIG. 3 as printing modules 40, 42, 44, 46, and 48 that are each used to deliver a single an application of toner 24 to form a toner image 25 on receiver 26. For example, the toner image 25 shown formed on receiver 26A in FIG. 1 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 1 as being formed on receiver 26B. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26. That is, any of the five colors of toner 24 can be combined with toner 24 of one or more of the other colors at a particular location on receiver 26 to form a color after a fusing or fixing process that is different than the colors of the toners 24 applied at that location.

In FIG. 1, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26 as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can each deliver a single application of toner 24 to a composite transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 3, these sources include memory 88, communication system 90, that printer 20 can receive such image data through local generation or processing that can be executed at printer 20 using, for example, user input system 84, output system 94 and printer controller 82. Print order information can also be generated by way of remote input and local input and can be calculated by printer controller 82. For convenience, these sources are referred to collectively herein as source of image data 108. It will be appreciated, that this is not limiting and that source of image data 108 can comprise any electronic, magnetic, optical or other system known in the art of printing that can be incorporated into printer 20 or that can cooperate with printer 20 to make print order information or parts thereof available.

In the embodiment of printer 20 that is illustrated in FIG. 1, printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

FIGS. 2-5 show more details of an example of a printing module 48 having a ratio modulated toner development system 100. However, it will be appreciated that any or all of printing modules 40, 42, 44, and 46 of FIG. 1 can have such a ratio modulated toner development system 100 and optionally any of the ratio modulated toner development systems 100 can be selectively activated by way of signals from printer controller 82.

As is shown of FIGS. 2-5 printing module 48 has a primary imaging system 110, a charging subsystem 120, a writing subsystem 130, a first development station 140 and a second development station 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

In this embodiment, ratio modulated toner development system 100 is shown incorporating writing subsystem 130, first development station 140 and second development station 200. In other embodiments other components of printer 20 or printing module 48 can optionally be used in ratio modulated toner development system 100, including but not limited to color separation processor 104 and half tone processor 106, primary imaging system 110 and charging subsystem 120.

Primary imaging system 110 includes a primary imaging member 112. In the embodiment of FIGS. 2-5, primary imaging member 112 is shown in the form of an imaging cylinder. However, in other embodiments primary imaging member 112 can take other forms, such as a belt or plate. As is indicated by arrow 109 in FIGS. 2-5, primary imaging member 112 is rotated by a motor (not shown) such that primary imaging member 112 rotates from charging subsystem 120, to writing subsystem 130, to first development station 140 and into a transfer nip 156 with a transfer subsystem 50.

In the embodiment of FIGS. 2-5, primary imaging member 112 has a photoreceptor 114. Photoreceptor 114 includes a photoconductive layer formed on an electrically conductive substrate. The photoconductive layer is an insulator in the substantial absence of light so that initial differences of potential VI can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential VI relative to ground. The initial difference of potential VI has a first polarity which can, for example, be a negative polarity. Here, charging subsystem 120 includes a grid 126 that is selected and driven by a power source (not shown) to charge photoreceptor 114. Other charging systems can also be used.

In this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential VI on photoreceptor 114. In other embodiments, a local controller or analog feedback circuit or the like can be used for this purpose.

Writing subsystem 130 is provided having a writer 132 that forms charge patterns on a primary imaging member 112. In this embodiment, this is done by exposing primary imaging member 112 to electromagnetic or other radiation that is modulated according to color separation image data to form a latent electrostatic image (e.g., of a color separation corresponding to the color of toner deposited at printing module 48) and that causes primary imaging member 112 to have ratio modulated charge patterns thereon.

In the embodiment shown in FIGS. 2-5, writing subsystem 130 exposes the uniformly-charged photoreceptor 114 of primary imaging member 112 to actinic radiation provided by selectively activating particular light sources in an LED array or a laser device outputting light directed at photoreceptor 114. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time. While various embodiments described herein describe the formation of an imagewise modulated charge pattern on a primary imaging member 112 by using a photoreceptor 114 and optical type writing subsystem 130, such embodiments are exemplary and any other system method or apparatuses known in the art for forming an imagewise modulated pattern differences of potential values on a primary imaging member 112 consistent with what is described or claimed herein can be used for this purpose.

As used herein, an "engine pixel" is the smallest addressable unit of primary imaging system 110 or in this embodiment on photoreceptor 114 which writer 132 (e.g., a light source, laser or LED) can expose with a selected exposure different from the exposure of another engine pixel. Engine pixels can overlap, e.g., to increase addressability in the slow-scan direction (S). Each engine pixel has a corresponding engine pixel location on an image and the exposure applied to the engine pixel location is described by an engine pixel level. As will be discussed in greater detail below, the engine pixel level is determined based upon a determined ratio of a first toner and a second toner to be supplied at an engine pixel location.

It will be appreciated that for any given combination of primary imaging member 112 and writing subsystem 130 there is a range of differences of potential that can be repeatedly established on a photoreceptor 114 or other type of primary imaging member 112 by writing subsystem 130. Typically, such a range is between a higher voltage level above which the response of the photoreceptor or other type of primary imaging member 112 becomes less repeatable or predictable than preferred and a lower difference of potential value below which the response of the photoreceptor or primary imaging member 112 becomes less repeatable or predictable than preferred. Accordingly, engine pixel levels used to form an image are generally calculated to create a difference of potential at each engine pixel location that is within a range determined based upon the higher difference of potential and the lower difference of potential and during printing or pre-printing processes a range of potential density with variations in image data to be printed is converted into engine pixel ratio modulated differences of potentials that are within the determined range of differences of potentials and formed on primary imaging member 112 or photoreceptor 114 by writing subsystem 130.

Writing subsystem 130 is a write-black or discharged-area development (DAD) system where image wise modulation of the primary imaging member 112 is performed according to a model under which a toner is charged to have the same first polarity as the charge on primary imaging member 112. As is used herein difference of potential refers to a difference of potential between the cited member and ground unless otherwise specified as the difference of potential between two members. This toner is urged to primary imaging member 112 by a net difference of potential between a first development station 140 and engine pixel locations on a the primary imaging member 112 during development. In the embodiment of FIGS. 2-5 this difference of potential varies based on the difference of potential at each engine pixel location. Toner of the same potential is urged to deposit onto engine pixel locations on the primary imaging member 112 where the difference of potential of an engine pixel location VEPL of primary imaging member 112 has been modulated from the initial difference of potential VI to a lower engine pixel level VEPL. The magnitude of the difference of potential an engine pixel location VEPL inversely corresponds to the engine pixel exposure level for the engine pixel location.

Accordingly, in a DAD system, toner develops on the primary imaging member 112 at engine pixel locations that have a difference of potential VEPL that is lower than a development difference of potential and does not develop on the primary imaging member 112 at engine pixel locations that have a ratio modulated difference of potential VEPL that is greater than a development difference of potential used to develop a toner at such locations. It will be appreciated that in this regard, any or all of printer controller 82, color separation image processor 104 and half tone processor 106 can optionally process image data and printing instructions in ways that cause ratio modulated differences of potential to be generated according to this DAD model.

Engine pixel locations having ratio modulated differences of potential that are less than the initial difference of potential VI therefore correspond to areas of primary imaging member 112 onto which toner will be deposited during development while areas having a ratio modulated potential that is above the development difference of potential are not developed with toner.

After writing, primary imaging member 112 has a ratio modulated difference of potential at each engine pixel location VEPL that can vary between a higher potential VH that can be at the initial difference of potential VI reflecting in this embodiment, a potential at an engine pixel location that has not been exposed, and that can be at a lower level VL reflecting in this embodiment a lower potential at an engine pixel location that has been exposed by an exposure at an upper range of available exposure settings.

Another meter 134 is optionally provided in this embodiment and measures charge within a non-image test patch area of photoreceptor 114 after the photoreceptor 114 has been exposed to writer 132 to provide feedback related to the ratio modulated differences of potentials created using writing subsystem 130 and photoreceptor 114. Other meters and components (not shown) can be included to monitor and provide feedback regarding the operation of other systems described herein so that appropriate control can be provided.

First development station 140 has a first toning shell 142 that provides a first developer having a first toner 158 near primary imaging member 112. First toner 158 is charged and has the same polarity as the initial charge VI on primary imaging member 112 and as any ratio modulated potential VEPL of the engine pixel locations on primary imaging member 112. First development station 140 also has a first supply system 146 for providing charged first toner 158 to first toning shell 142 and a first power supply 150 for providing a bias for first toning shell 142. First supply system 146 can be of any design that maintains or that provides appropriate levels of charged first toner 158 at first toning shell 142 during development. Similarly, first power supply 150 can be of any design that can maintain the bias described herein. In the embodiment illustrated here, first power supply 150 is shown optionally connected to printer controller 82 which can be used to control the operation of first power supply 150.

The bias at first toning shell 142 creates a first development difference of potential VD1 relative to ground. The first development difference of potential VD1 forms a first net development difference of potential VNET1 between first toning shell 142 and individual engine pixel locations on primary imaging member 112. The first net development difference of potential VNET1 is the first development difference of potential VD1 less any ratio modulated difference of potential VEPL at the engine pixel location.

First toner 158 on first toning shell 142 develops on individual engine pixel locations of primary imaging member 112 in an amount according to the first net development potential VNET1 for the individual engine pixel. The amount of first toner developed at such an engine pixel location can increase along with increases in the first net development difference of potential VNET1 for each individual engine pixel location and these increases in amount can occur monotonically with increases in the first net development difference of potential. Such development produces a first toner image 25 on primary imaging member 112 having first toner 158 in amounts at the engine pixel locations that correspond to the engine pixel levels associated with the engine pixel locations.

The electrostatic forces that cause first toner 158 to deposit onto primary imaging member 112 can include Coulombic forces between charged toner particles and the charged electrostatic latent image, and Lorentz forces on the charged toner particles due to the electric field produced by the bias voltages.

In one example embodiment, first development station 140 employs a two-component developer that includes toner particles and magnetic carrier particles. In this embodiment, first development station 140 includes a magnetic core 144 to cause the magnetic carrier particles near first toning shell 142 to form a "magnetic brush," as known in the electrophotographic art. Magnetic core 144 can be stationary or rotating, and can rotate with a speed and direction the same as or different than the speed and direction of first toning shell 142. Magnetic core 144 can be cylindrical or non-cylindrical, and can include a single magnet or a plurality of magnets or magnetic poles disposed around the circumference of magnetic core 144. Alternatively, magnetic core 144 can include an array of solenoids driven to provide a magnetic field of alternating direction. Magnetic core 144 preferably provides a magnetic field of varying magnitude and direction around the outer circumference of first toning shell 142. Further details of magnetic core 144 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development station 140 can also employ a mono-component developer comprising toner, either magnetic or non-magnetic, without separate magnetic carrier particles. In further embodiments, first development station 140 can take other known forms that can perform development in any manner that is consistent with what is described and claimed herein.

In the embodiment of FIGS. 2-5, a second development station 200 has a second toning shell 204 that provides a second developer having a second toner 208 near primary imaging member 112. Second toner 208 is charged and has a potential of the same polarity as first toner 158, the initial charge VI on primary imaging member 112 and any ratio modulated difference of potential of the engine pixel locations VEPL. Second development station 200 also has a second toner supply system 206 for providing charged second toner 208 of the first polarity to second toning shell 204 and a second power supply 210. Second toner supply system 206 can be of any design that maintains or that provides appropriate levels of charged second toner 208 at a second toning shell 204 during development. Similarly, second power supply 210 can be of any design that can maintain the bias described herein on second toning shell 204. In the embodiment illustrated here, second power supply 210 is shown optionally connected to printer controller 82 which can be used to control operation of second power supply 210.

As is also shown in FIG. 3, when a bias is applied at a second toning shell 204 by second power supply 210, a second development difference of potential VD2 is created relative to ground. The second development difference of potential VD2 forms a second net development difference of potential VNET2 between second toning shell 204, any first toner 158 at an individual engine pixel location on primary imaging member 112 and the ratio modulated difference of potential VEPL at the individual engine pixel location. The second net development difference of potential VNET2 for an engine pixel location is the second development difference of potential VD2 less any ratio modulated difference of potential VEPL at the engine pixel location and less any first toner difference of potential VFT provided by any first toner 158 at the engine pixel location. It will be appreciated however, that because second development occurs after first development, the sum of the ratio modulated difference of potential VEPL and any first toner difference of potential VFT provided by any first toner at the engine pixel location will typically be at the first development difference of potential VD1.

Second toner 208 on second toning shell 204 can deposit on individual engine pixel locations on primary imaging member 112 in a first amount that reflects the difference between first development difference of potential VD1 and second development difference of potential VD2 and in a second amount that monotonically increases as a function of the second net development difference of potential VNET2. Such increases can occur monotonically with increases in the second net development difference of potential VNET2.

The electrostatic forces that cause second toner 208 to deposit onto primary imaging member 112 can include Coulombic forces between charged toner particles and the charged electrostatic latent image, and Lorentz forces on the charged toner particles due to the electric field produced by the bias voltages. Second development station 200 can optionally employ a two-component developer or a one component developer and a magnetic core as described generally above with reference to first development station 140.

Figure 4:
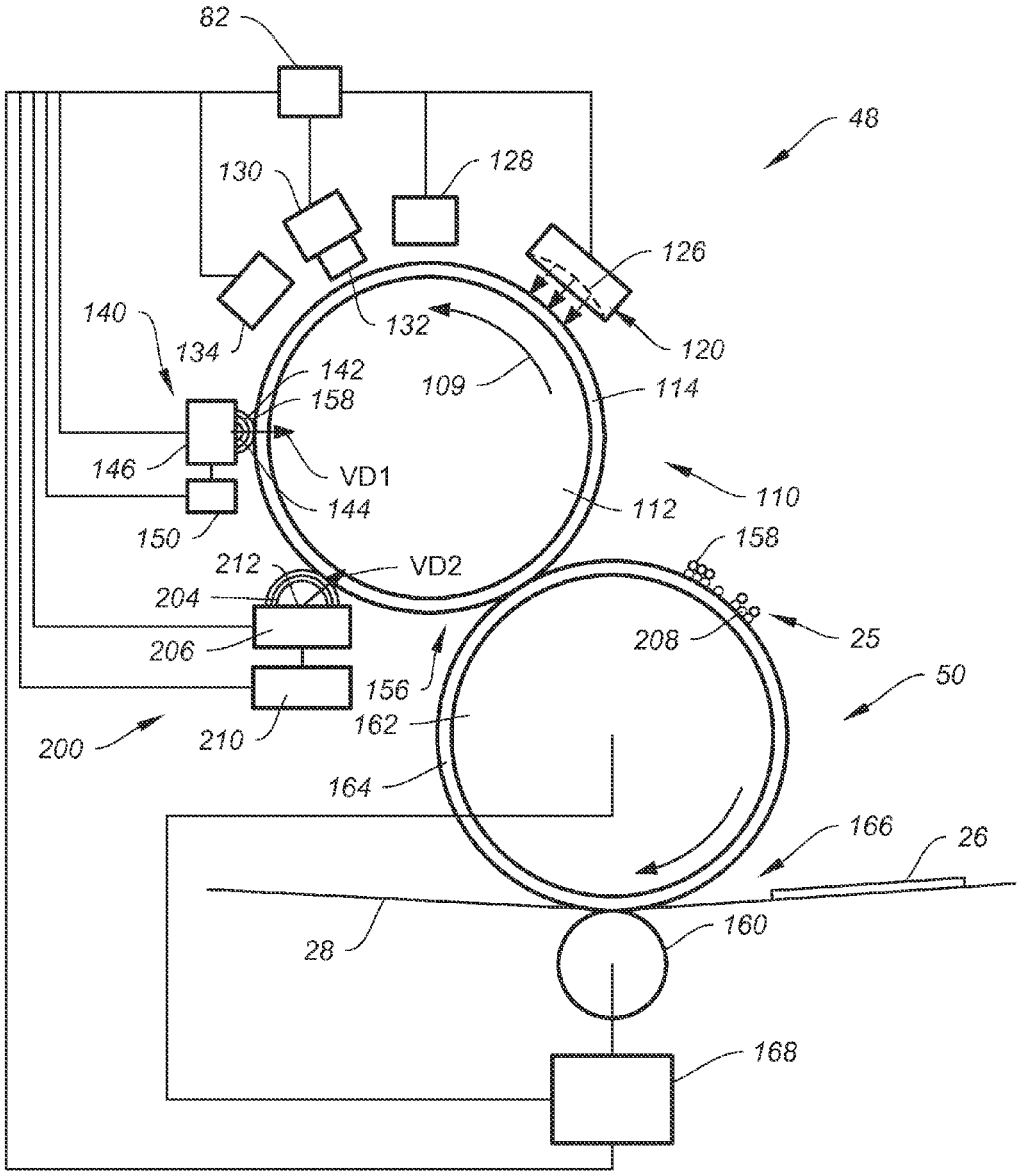
FIG. 4 illustrates the embodiment of FIG. 2 during transfer.
Figure 5:
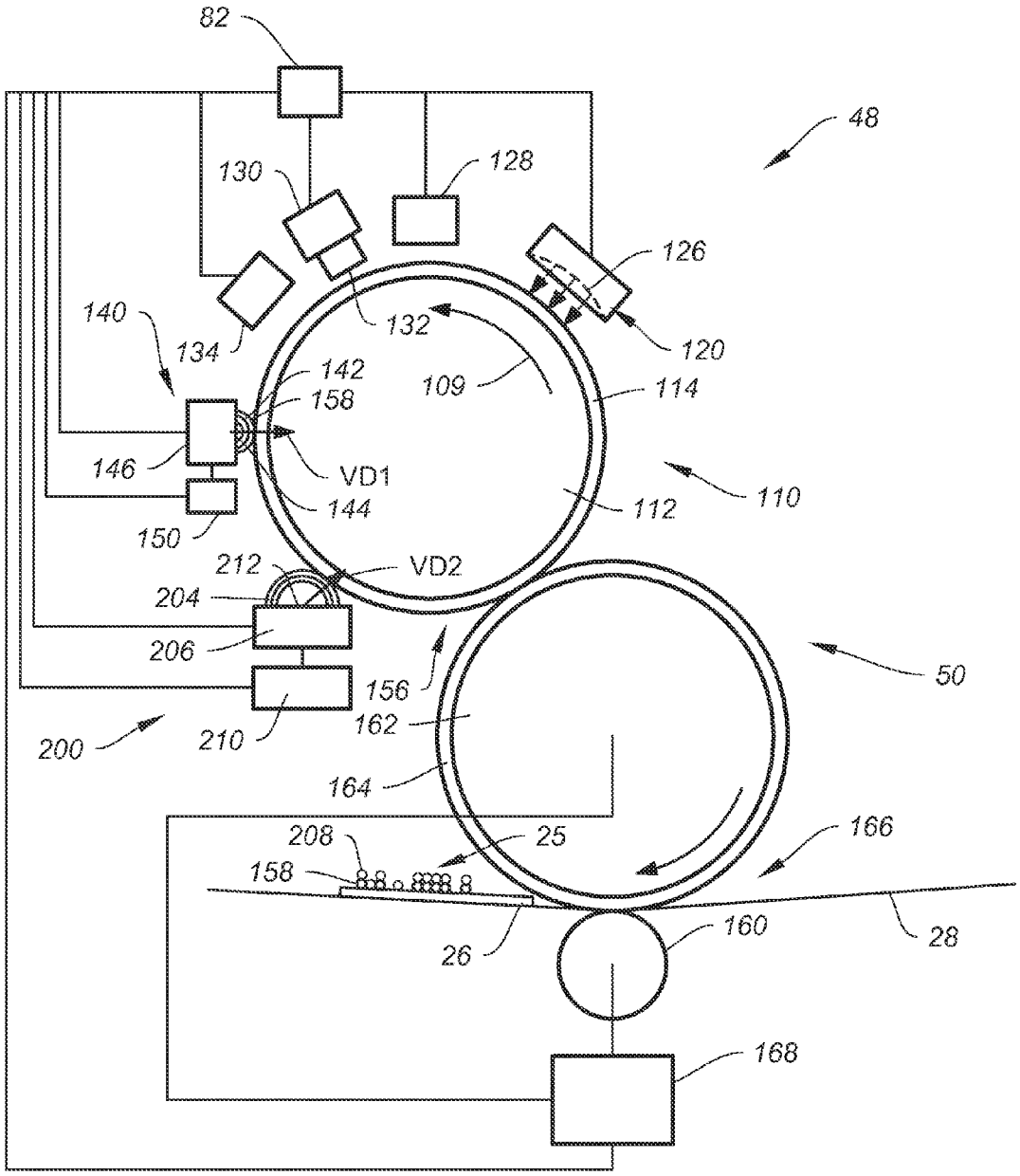
FIG. 5 illustrates the embodiment of FIG. 2 during transfer.

As is shown in FIG. 4, in this embodiment, after a first toner image 25 is formed having first toner 158 and second toner 208, rotation of primary imaging member 112 causes first toner image 25 to move into a first transfer nip 156 between primary imaging member 112 and a transfer subsystem 50. As shown in FIG. 4, in this embodiment transfer subsystem 50 has an intermediate transfer member 162 that receives toner image 25 at first transfer nip 156. As is shown in FIG. 5, intermediate transfer member 162 then rotates to move first toner image 25 to a second transfer nip 166 where a receiver 26 receives first toner image 25. In this embodiment, transfer subsystem 50 includes transfer backup member 160 opposite intermediate transfer member 162 at second transfer nip 166. Receiver transport system 28 passes at least in part through transfer nip 166 to position receiver 26 to receive toner image 25. In this embodiment, intermediate transfer member 162 is shown having an optional compliant transfer surface 164.

After a toner image 25 has been formed on primary imaging member 112 or has been transferred been transferred to intermediate transfer member 162, adhesion forces such as van der Waals forces resist separation of toner image 25 from these members unless another force is provided that overcomes these adhesive forces. In the embodiment of FIG. 3, the first toner difference of potential VFT is used to allow such force to be applied to toner image 25 to enable transfer of toner image 25 onto intermediate transfer member 162 and later to enable transfer from intermediate transfer member 162 and on to a receiver 26. As is illustrated in the embodiment of FIGS. 2-5 a transfer power supply 168 creates a difference of potential between primary imaging member 112, and a difference of potential between transfer member 162 and transfer backup member 160. These differences in potential are used to cause toner image 25 to transfer from primary imaging member 112 to intermediate transfer member 162 and to transfer from the intermediate transfer member 162 to the receiver 26.

Returning to FIG. 1, it will understood that printer controller 82 causes one or more of individual printing modules 40, 42, 44, 46 and 48 to generate a toner image 25 for transfer by respective transfer subsystems 50 to a receiver 26 in registration to form a composite toner image 27.

Second toner 208 is different than first toner 158. This can take many forms, in one embodiment, first toner 158 can have first color characteristics while second toner 208 has different second color characteristics. In one example of this type, first toner 158 can be a toner of a first color having a first hue and the second toner 208 can be a toner having the first color and a second different hue.

First toner 158 and second toner 208 also can have different material properties. For example, in one embodiment first toner 158 can have a first viscosity and the second toner 208 can have a second viscosity that is different from the first viscosity. In another embodiment, first toner 158 can have a different glass transition temperature than second toner 208. In one example of this type, second toner 208 can have a lower glass transition temperature than the first toner 158. In certain embodiments, first toner 158 can comprise one of the color toners used to form a color image while second toner 208 can take the form of a toner that is clear, transparent or semi-transparent when fused. In other embodiments, second toner 208 can have finite transmission densities when fused.

First toner 158 and second toner 208 can be differently sized. For example, and without limitation, first toner 158 can comprise toner particles of a size between 4 microns and 9 microns while second toner 208 can have toner particles of a size between 10 microns and 20 microns or more. In another non-limiting example, second toner 208 can comprise toner particles of a size between 4 microns and 9 microns while first toner 158 can have toner particles of a size between 10 microns and 20 microns or more. First toner 158 and second toner 208 can also have other different properties such as different shapes, can be formed using different processes, or can be provided with additional additives, coatings or other materials known in the art that influence the development, transfer or fusing of toner.

In general then, a printer 20 having a printing module 48 with ratio modulated toner development system 100 can develop a combination of a first toner 158 and second toner 208 according to and in precise registration with ratio modulated differences of potential at specific engine pixel locations on a primary imaging member 112.

Figure 6A:
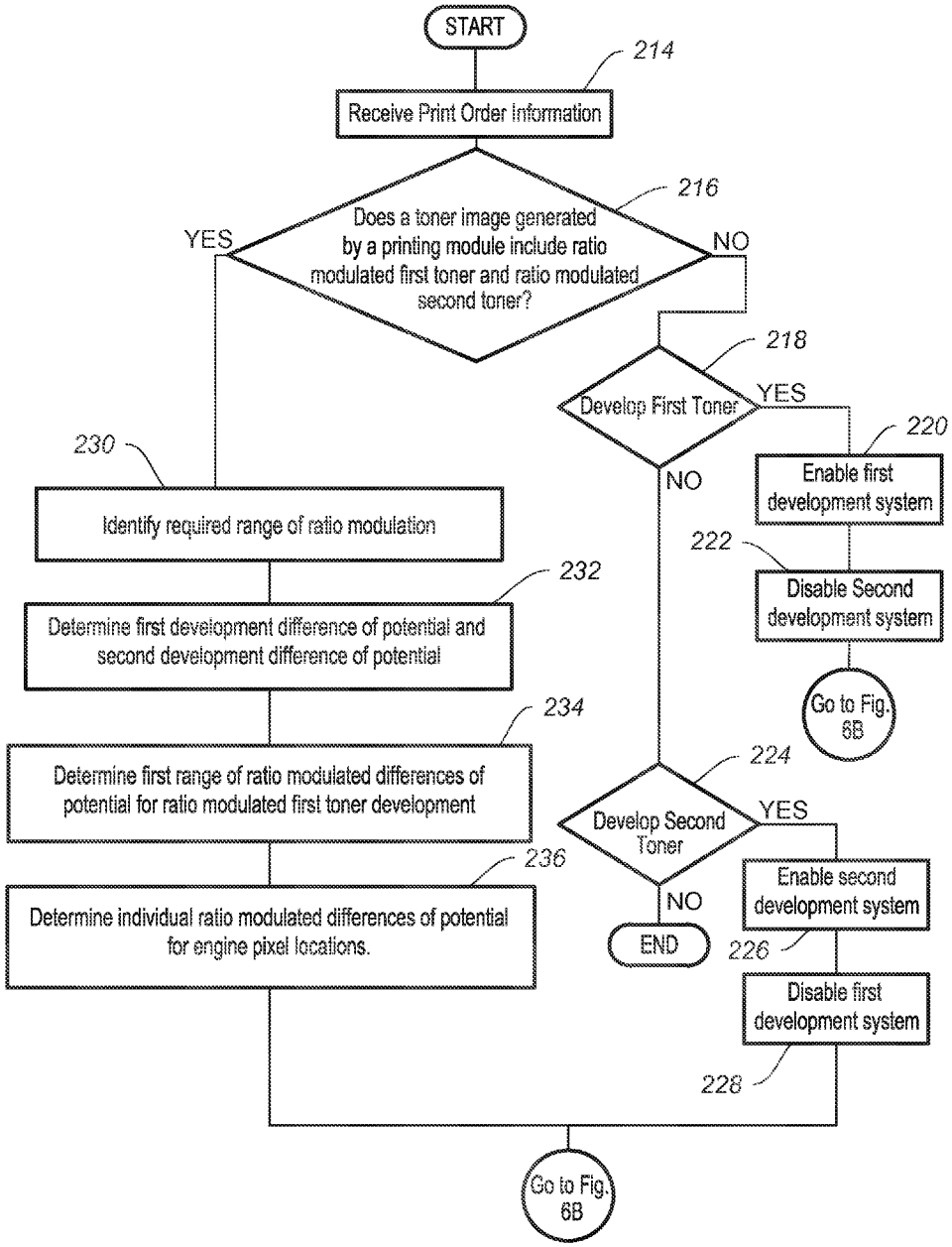
FIGS. 6A-6B show a first embodiment of a printing method using a printing module having a ratio modulated toner development system.
Figure 6B:
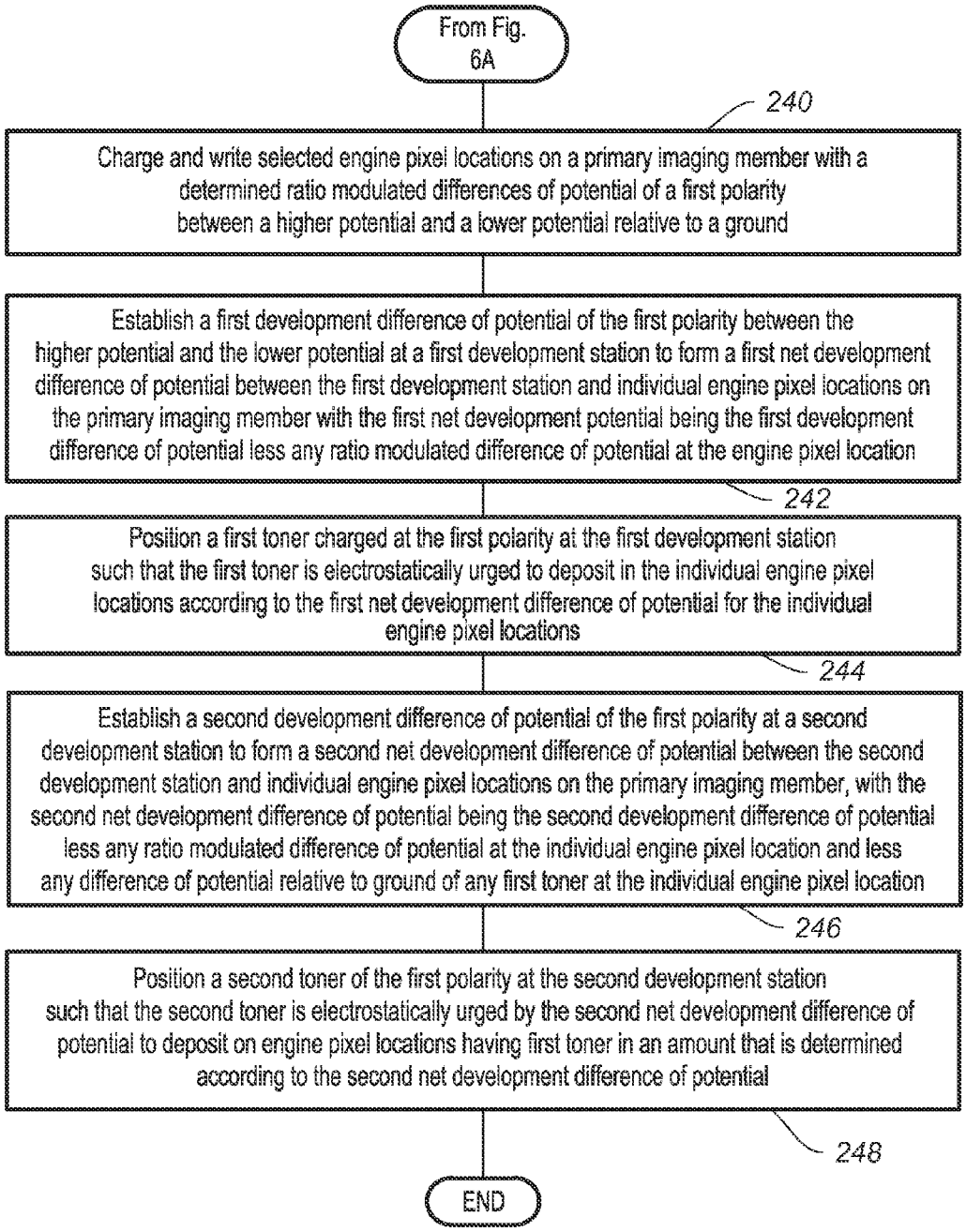

FIGS. 6A and 6B show a first embodiment of a method for operating a printer to provide ratio controlled amounts of a first toner 158 and a second toner 208 at an engine pixel location.

In accordance with the illustrated method, print order information for printing is received. In the embodiment of FIG. 1, this print order information can be received from a source of print order information 108. The print order information can include for example image data and printing instructions or information that can be used to obtain or determine such image data or printing instructions as is generally described above.

A determination is then made as to whether making a print according to the print order information involves generating a toner image 25 that provide ratio controlled amounts of a first toner 158 and a second toner 208 at an engine pixel location (step 216).

In one embodiment, this determination is made based upon the print order information. For example, a color image data can be determinative of whether such a toner image 25 is to be generated. Alternatively, this determination can be made based upon printing instructions that can be included with the print order information. In still another alternative, this determination can be made based upon information that can be derived from print order information or the image data.

In still other embodiments, this determination can be made by analyzing the color, textural, functional, electrical, mechanical, chemical or biological properties that the print order information indicates are to be provided in an image that can be satisfied using controlled ratios of first toner 158 and second toner 208 to be used to render an image having such properties. For example, such a determination can be made where analysis of the print order indicates that a first set of locations in an image is to have a combination of a first and a second toner that provides high gloss in one area and a while a second set of locations in the same image is to have combination of a first toner and second toner that yields a lower gloss.

In further embodiments, settings made using user input system 84 can be used to determine a need to generate a toner image 25 having a controlled ratios of a first toner 158 and second toner 208.

It will be appreciated that these examples are not limiting and that any circumstance known in the art suggesting that a print is to be generated using a toner image 25 having both first toner 158 and second toner 208 can drive these determinations. It will be further appreciated that in printer 20 of FIG. 1 such determinations can be made automatically by, for example, printer controller 82 or color separation processor 104 acting alone or in combination.

As is shown in FIG. 6A, where it is determined that a toner image 25 does not require provide ratio controlled amounts of a first toner 158 and a second toner 208 at an engine pixel location, it is then decided whether first toner 158 is to be developed for toner image 25 (step 218). Where first toner is to be developed, first development system 140 is enabled (step 220) and second development station 200 is disabled (step 222), and the process moves to the steps described in FIG. 6B. Further, where it is determined that toner image 25 does not include first toner 158, a determination is made as to whether second toner 208 is to be used (step 224) where it is determined that second toner 208 is to be developed, second development station 200 is enabled (step 226) and first development station 140 is disabled (step 228). Where no first or second toner is to be developed the process concludes and no toner is developed.

However, where it is determined that a toner image 25 is to provide ratio controlled amounts of a first toner 158 and a second toner 208 at an engine pixel location (step 216), an overall range of ratio modulation required for the ratios to be formed in the engine pixel locations of the image is determined (step 230). This is typically done by analyzing the data discussed with reference to step 216 that indicates that there is such a need to determine the total range of possible ratios of first and second toner that can be required.

Once that the required range of ratios is determined, a first development difference of potential VD1 is determined and a second development difference of potential VD2 is determined for use developing first toner 158 and second toner 208 in order to provide the required ratios (step 232).

One process by which these determinations can be made will now be discussed with reference to FIGS. 7A and 7B. It will be appreciated from FIG. 7A, that when a single toner is developed across a range of ratio modulated differences of potential VEPL, a portion of the post development difference of potential at the engine pixel location is provided by the first toner 158 and that a portion of the post development difference of potential is provided by the ratio modulated difference of potential. Further, as is illustrated in FIG. 7A when a single toner is developed the entire range of available ratio modulated differences of potential at an engine pixel location between a lower difference of potential VL and a higher difference of potential VH is available to provide a broad range of possible toner delivery outcomes in response to an ratio modulated difference of potential.

Figure 7A:
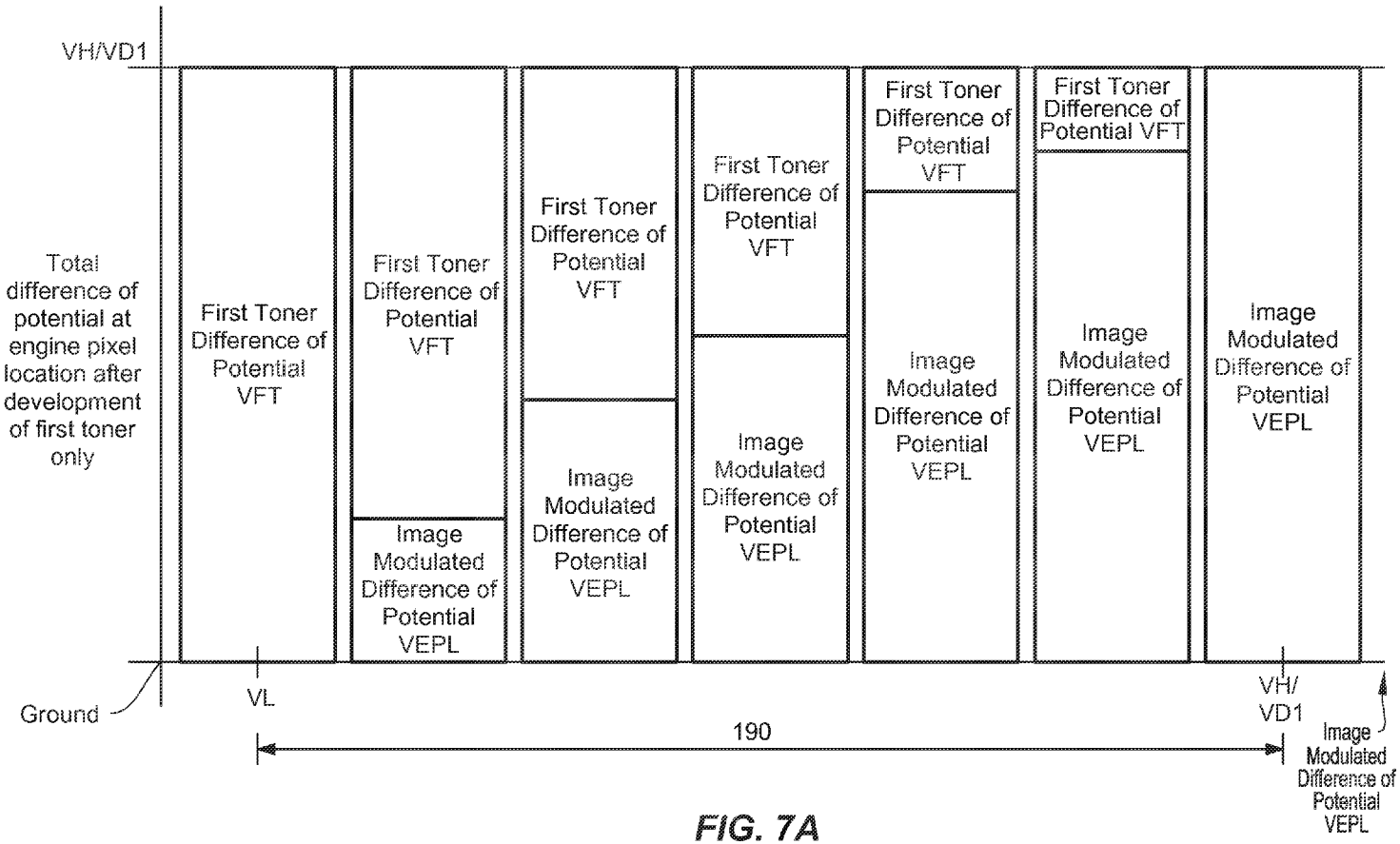
FIG. 7A-7B illustrate a range of possible ratios of a first toner difference of potential and a second toner difference of potential that can be achieved based upon different levels of ratio modulated differences of potential.

It will also be appreciated from FIG. 7A that in a conventional DAD system the sum total of the difference of potential created by the first toner 158 at an engine pixel location and the amount of ratio modulated difference of potential VEPL at the engine pixel location, will, aside from development efficiency losses, generally equal the first development difference of potential VD1. Further, it will be understood that a ratio modulated difference of potential of VD1 or greater will prevent development of the first toner 158.

Accordingly, to cause a second toner 208 to develop together with the first toner 158 at the engine pixel location, a second development potential VD2 will be required that is at a level that is greater than the first development difference of potential VD1. This second development difference of potential VD2 creates a second net development difference of potential that, for the reasons just discussed above, will be generally equal to the second development difference of potential VD2 less the first development difference of potential VD 1. This will therefore cause a generally fixed amount of development of second toner 208 to develop at the engine pixel locations when the ratio modulated differences of potentials are in a range that will cause the determined range of amounts of first toner 158 to be developed.

Figure 7B:
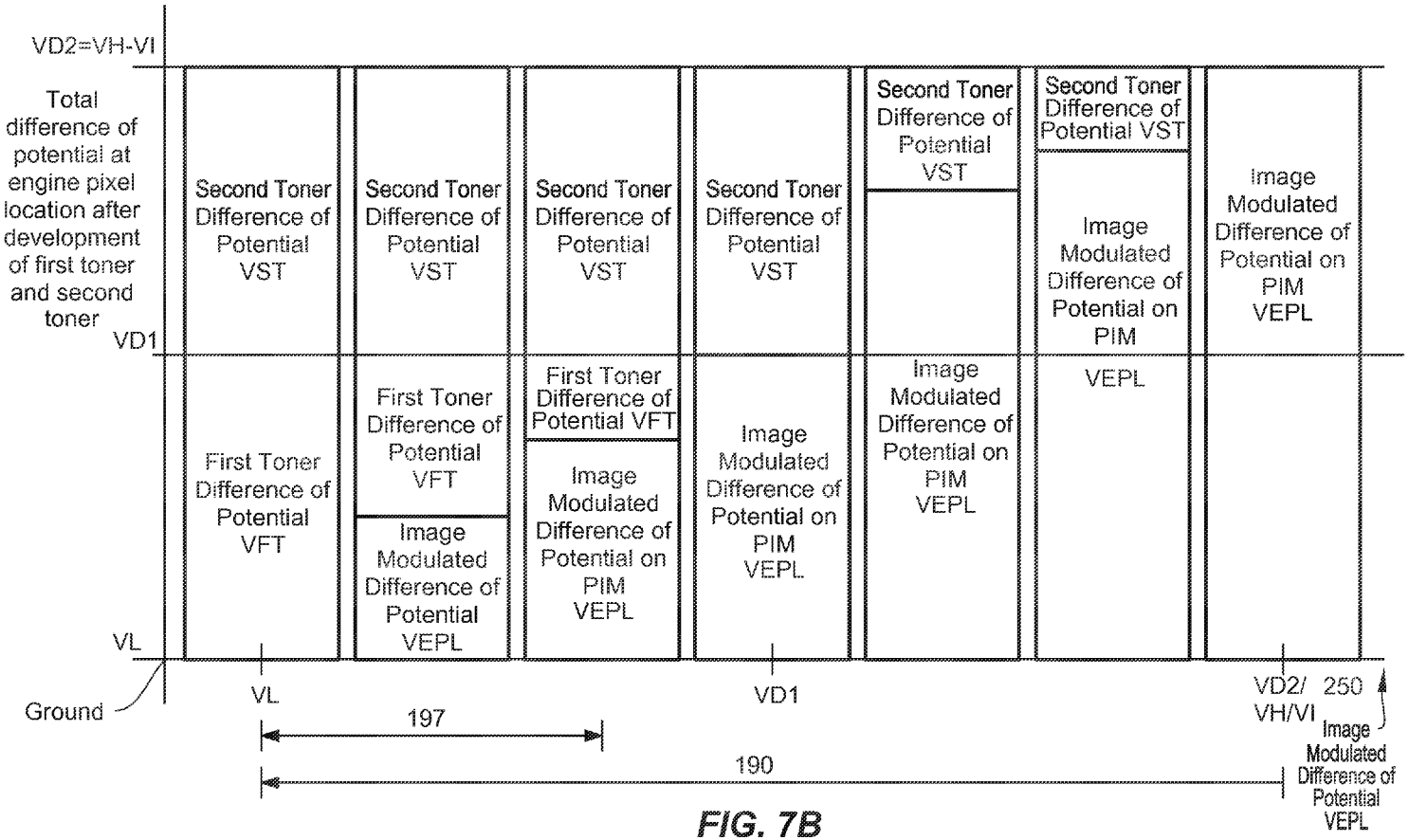

FIG. 7B illustrates a possible set of outcomes that can provide a range of ratios of first toner 158 to second toner 208 that is between 1:1 and 1:4. In this example, this is done by first determining a range of first toner amounts that can be developed in response to a ratio modulated difference of potential that is between a low ratio modulated difference of potential VL and a high ratio modulated difference of potential VH. The first development difference of potential VD1 is then established to allow development within the determined range. Typically, in a DAD system this will cause the higher ratio modulated difference of potential VH and the first development difference of potential VD1 to be set at the same differences of potential.

A second development difference of potential VD2 is then set at a level that is sufficiently greater than the first development difference of potential VD1 so as to cause a fixed amount of second toner 208 to develop on the first toner 158 developed at an engine pixel location when the engine pixel location has a ratio modulated difference of potential VEPL that causes an amount of first toner 158 to develop that is with the determined range of first toner amounts. This creates a ratio of the first toner 158 to the second toner 208 at such an engine pixel location that is within the determined range and that at a position in the range that is determined in accordance with the ratio modulated difference of potential.

It will be appreciated that the amount of second toner 208 that is developed using ratio modulated development system 100 is generally fixed at a level that is determined by the difference between the second development difference of potential VD2 and the first development difference of potential VD1. Accordingly the range of possible ratios of first toner 158 to a second toner 208 occurs as a function of extent to which the amount of first toner 158 can be varied in response a ratio modulated difference of potential VEPL at an engine pixel location at which a predetermined amount of second toner 208 will be developed. Once that the range of variability of the amounts of the first toner 158 has been determined, an amount of second toner 208 can be determined that causes the determined range of variability of the amounts of first toner 158 to provide the determined range of ratios.

As is shown in FIG. 7B, when it is determined that the range of ratios of first toner 158 and second toner 208 to be formed at the engine pixel locations used to make a toner image 25, are to be, for example between the ratios of 1:1 and a ratio of 1:4 and that for a given first development difference of potential first toner 158 can be developed in amounts that vary between a 40 units and 10 units then the second development difference of potential VD2 will be set at a level that causes the amount of second toner 208 that is to be developed during development of the first toner to be at 40 units. In such an arrangement, the ratio modulated difference of potential can be set at a level that causes 40 units of first toner 158 to be generated when a 1:1 ratio is to be provided and at a second higher level that causes 10 units of first toner 158 to be generated when a 1:4 ratio is to be provided.

The first development difference of potential VD1 can also be varied to the extent that such variations are made within a range of ratio modulation of the engine pixel locations.

Once that the first development difference of potential VD1 and the second development difference of potential VD2 are determined, the ratio modulated difference of potential for the engine pixel locations (step 236).

In one example, this can be done by mapping the range of determined amounts of first toner 158 into the range of available ratio modulated differences of potential shown in FIG. 7B as range 190. As is shown in FIG. 7B, in some cases the range of determined amounts of first toner 158 can be provided in response to a range 197 of ratio modulated differences of potentials that is less than the range 190 of available ratio modulated differences of potentials for the engine pixel locations VEPL, while in other embodiments, the range 197 of ratio modulated differences of potential can be coextensive with the available range 190.

Such mapping can be linear or otherwise depending on the extent and nature of differences between the range of ratios that are determined from the print order information or that are otherwise called for in a toner image 25 and the range of available ratio modulated differences of potential VEPL for the engine pixel locations. This mapping can optionally be influenced by the extent to which writing subsystem 130 is capable of providing differences of potentials at an engine pixel location that can be differentially developed by the first development station 140. Such mapping can optionally be influenced by optical or functional characteristics of the toner, the printing process used develop or transfer toner as well as characteristics of the receiver onto which the first toner 158 and the second toner 208 will be transferred. The mapping is used to convert the ratios called determined from the print order information or otherwise called for in a toner image 25.

In still other embodiments, there can be a limitation as to an amount of second toner 208 that can be developed or there may be a desire to limit the amount of second toner 208 to reduce the amount of first toner 158 required to form a specific ratio of first toner 158 and second toner 208 at an engine pixel location such that it is desirable to use the amount of second toner 208 to be supplied as the primary limitation of the ratio determining system. In such situations, the difference between first development difference of potential VD1 and second development difference of potential VD2 can be set to provide the desired range of ratios of first toner 158 to second toner 208 based upon the limited quantity of second toner 208. A range of first toner 158 required to form the desired range of ratios of the first toner 158 and second toner 208 can then be determined and mapped into a range of available ratio modulated differences of potentials VEPL as is generally described above.

Ratio modulated differences of potentials for individual engine pixel locations are determined by determining a desired ratio of the first toner 158 and the second toner 208 from the image data otherwise and then using the mapping to determine an appropriate setting for the ratio modulated differences of potentials VEPL (step 236).

Turning now to FIG. 6B, engine pixel locations are charged with the determined ratio modulated differences of potentials VEPL (step 240). This can be done, for example, as described above in the printing module 48 of FIGS. 2-5 using charging subsystem 120 and writing subsystem 130 to expose a photoreceptor 114 to selectively release charge on photoreceptor 114. In other embodiments, this step can also be performed using any other charging-writing system that is compatible with a discharge area development process.

The determined first development difference of potential VD1 of the first polarity is established at first toning shell 142 using, in this example, first power supply 150. This creates a first net development difference of potential VNET1 defined by the difference between the first development difference of potential VD1 at first toning shell 142 and the ratio modulated difference of potential VEPL at the individual engine pixel locations on primary imaging member 112. The first net development difference of potential VNET1 for an engine pixel location is the first development difference of potential VD1 less any ratio modulated difference of potential VEPL at the engine pixel location (step 242).

Particles of first toner 158 are charged to the first polarity and positioned between first toning shell 142 and the engine pixel locations so that the first net development difference potential VNET1 electrostatically urges first toner 158 to deposit first toner 158 at individual engine pixel locations according to the first net development potential VNET1 for the individual picture element locations (step 244).

A second development difference of potential VD2 of the first polarity is established at second toning shell 204 using for example, second power supply 210. This creates a second net development difference of potential VNET2 between the second toning shell 204 and the individual engine pixel locations on the primary imaging member. The second net development difference of potential VNET2 between the second toning shell 204 and the individual image pixel locations is the second development difference of potential VD2, less a difference of potential of the first toner VFT at the individual engine pixel location and less the ratio modulated difference of potential VEPL at the individual engine pixel location (step 246).

Second toner 208 having a charge of the first polarity is positioned so that the second net development potential VNET2 electrostatically urges second toner 208 to deposit on the engine pixel locations to form a first toner image 25 having first toner 158 at each picture element location in amounts that are modulated by the second net development potential VNET2 (step 248).

When the second toner 208 is so positioned, the second development difference of potential VD2 is greater than the first development difference of potential VD1 but less than an initial difference of potential VI on the primary imaging member 112. This causes at least a first amount of second toner 208 to deposit on individual engine pixel locations having the first toner 158 according to the second net difference of potential VNET2 between second development difference of potential VD2, the potential VFT of any first toner 158 at an individual engine pixel location and the ratio modulated potential VEPL at the individual engine pixel locations. Accordingly when second net development difference of potential VNET2 increases the amount of second toner 208 increases.

Figure 8A:
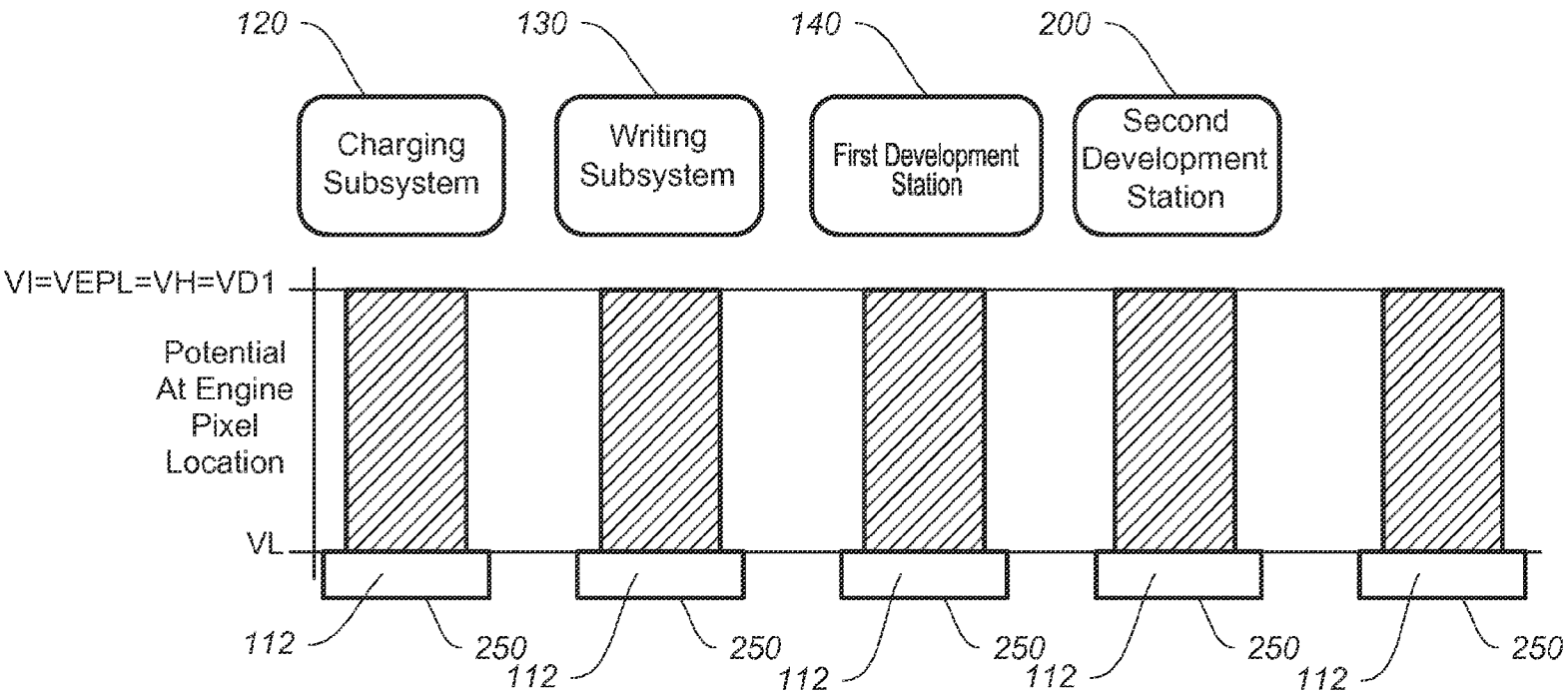
FIGS. 8A-8D illustrate an example of a spectrum of different outcomes that can be made possible using methods such as those shown in FIGS. 6A-6B.

An example of a spectrum of different outcomes that could be achieved using the method of FIGS. 6A-6B is illustrated generally in FIGS. 8A-8D. As is illustrated in FIG. 8A, when the ratio modulated potential VEPL at an engine pixel location 250 is at a first level that is at the initial difference of potential VI the first development difference of potential VD1 is not greater than initial difference of potential VI, and there is no net first development difference of potential VNET1 between first development station 140 and engine pixel location 250. Similarly, because at engine pixel location 250 the second development difference of potential VD2 is not greater than the initial difference of potential VI, there is no net second development difference potential VNET2 and no development of second toner 208 at engine pixel location 250.

Figure 8B:
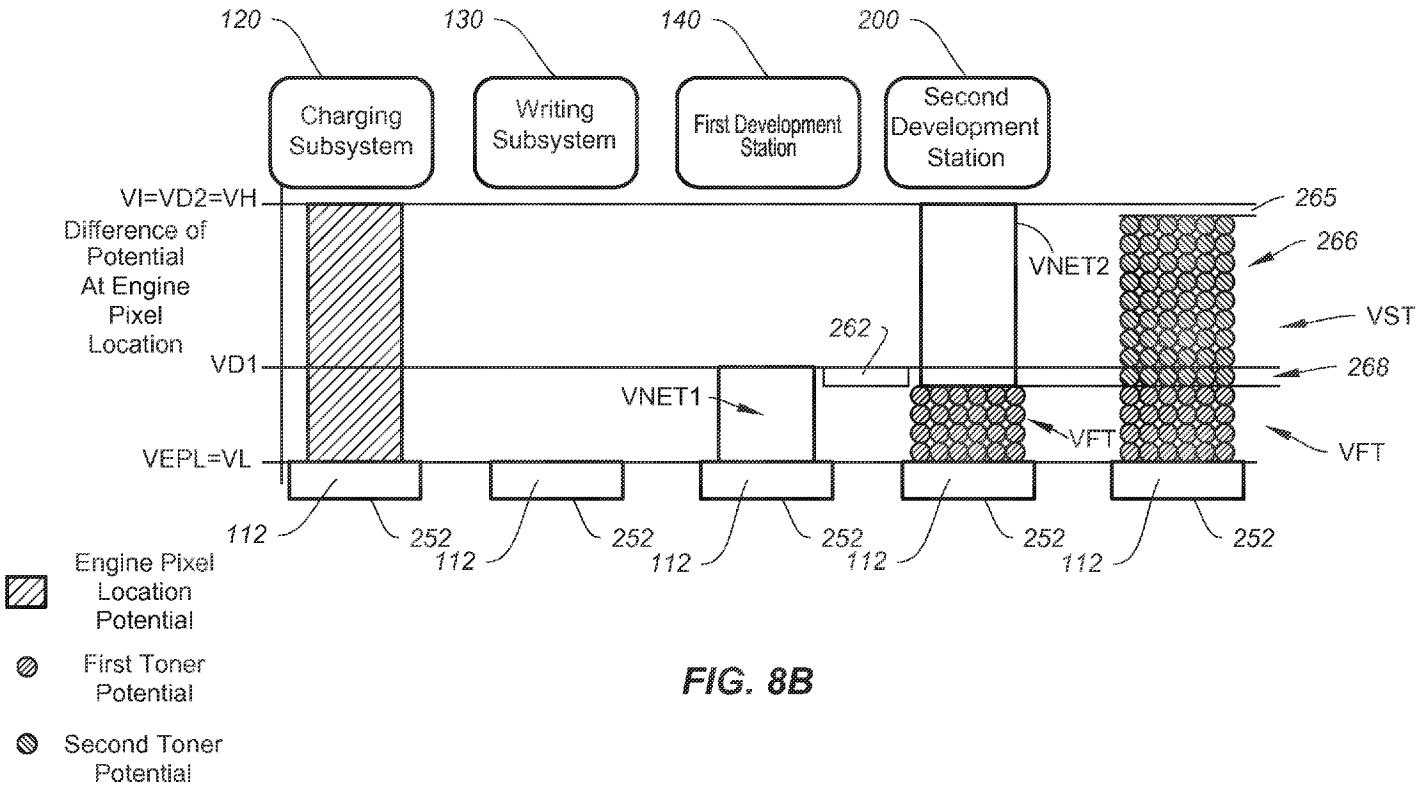

FIG. 8B illustrates the operation of the method of FIGS. 6A and 6B at a second ratio modulated difference of potential at another engine pixel location 252. As is illustrated here, first toner 158 deposits at engine pixel location 252 having the second ratio modulated difference of potential until an amount of the charged first toner 158 deposited reaches a first toner potential VFT that is determined by the first net difference of potential VNET1 between first development difference of potential VD1 and the second ratio modulated difference of potential which here is at the lower voltage VL which is illustrated as ground and less a first development shortfall 262 that arises due to development efficiency being less than unity. Thus, the amount of first toner 158 developed is that which is necessary to create the first development difference of potential VD1.

As is further shown in FIG. 8B, after second development of an engine pixel location 252 that has the second ratio modulated difference of potential and an amount of first toner 158 that creates a first toner difference of potential VFT of the first development difference of potential VD1, also has an amount of second toner 208 deposited that reaches a difference of potential of second toner VST that is at a net second development difference of potential VNET2 of the second development difference of potential VD2 less the first toner difference of potential VFT and less a second development shortfall 272 that arises due to development efficiency being less than unity.

Figure 8C:
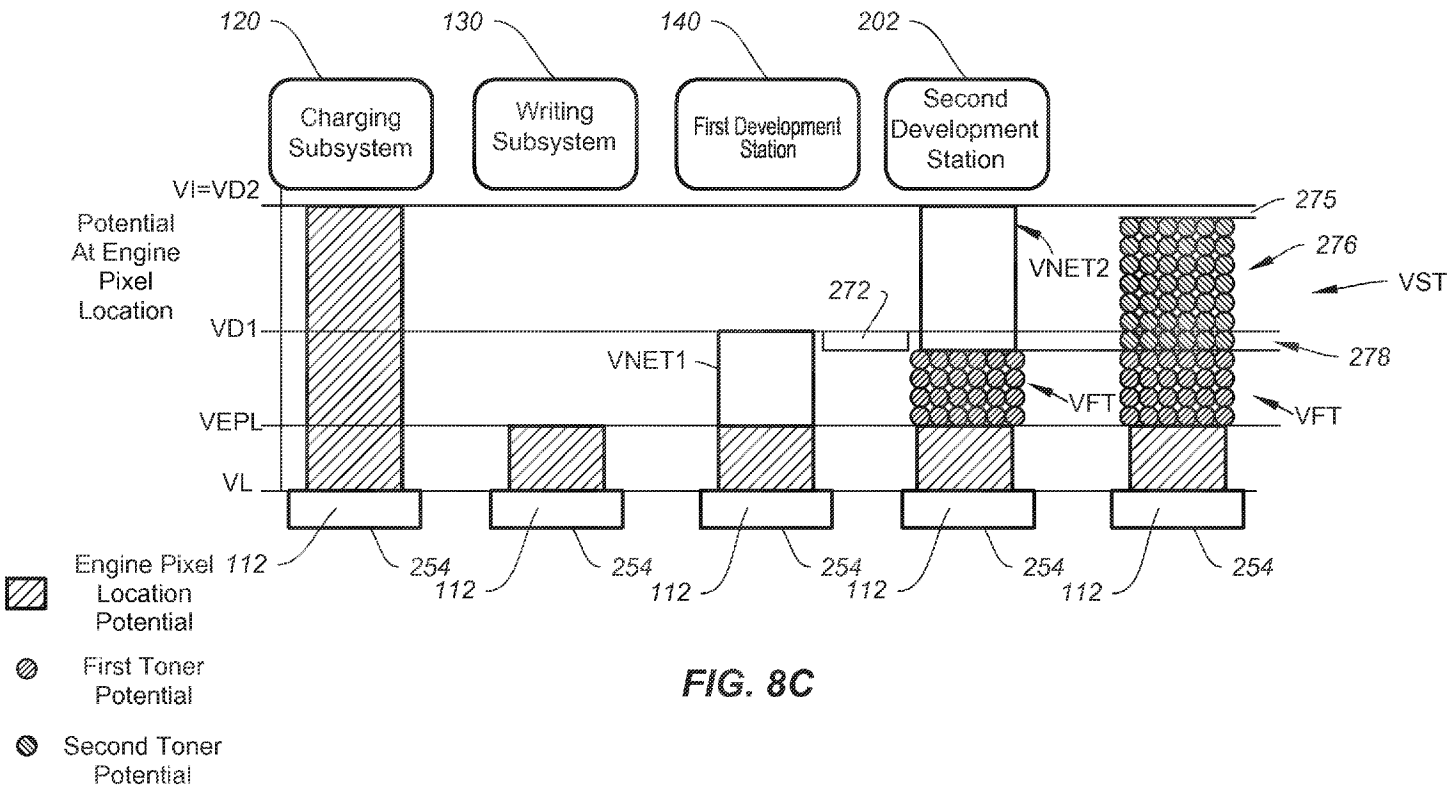

FIG. 8C illustrates the operation of the method of FIG. 6A and 6B at an engine pixel location 254 that has a third ratio modulated difference of potential that is within first toner development range. In this example, first toner 158 deposits at the engine pixel location until the first toner 158 at engine pixel reaches a first toner difference of potential VFT that is generally the same as the first net development difference of potential VNET1 of first development difference of potential VD1 less the third ratio modulated difference of potential VEPL at engine pixel location 254. As is further shown in FIG. 8C, second development at engine pixel location 254 provides a second net development difference of potential VNET2 of the second development difference of potential VD2 less the first toner potential VFT, and less the ratio modulated potential VEPL at engine pixel location 254 and less any development shortfall 275 that arises where the development efficiency of the second development step is less than unity. Thus, while ratio modulated development of first toner 158 occurs for ratio modulated differences of potentials in the first toner development range, second toner 208 is not ratio modulated by variations in the ratio modulated difference of potentials within this range.

Figure 8D:
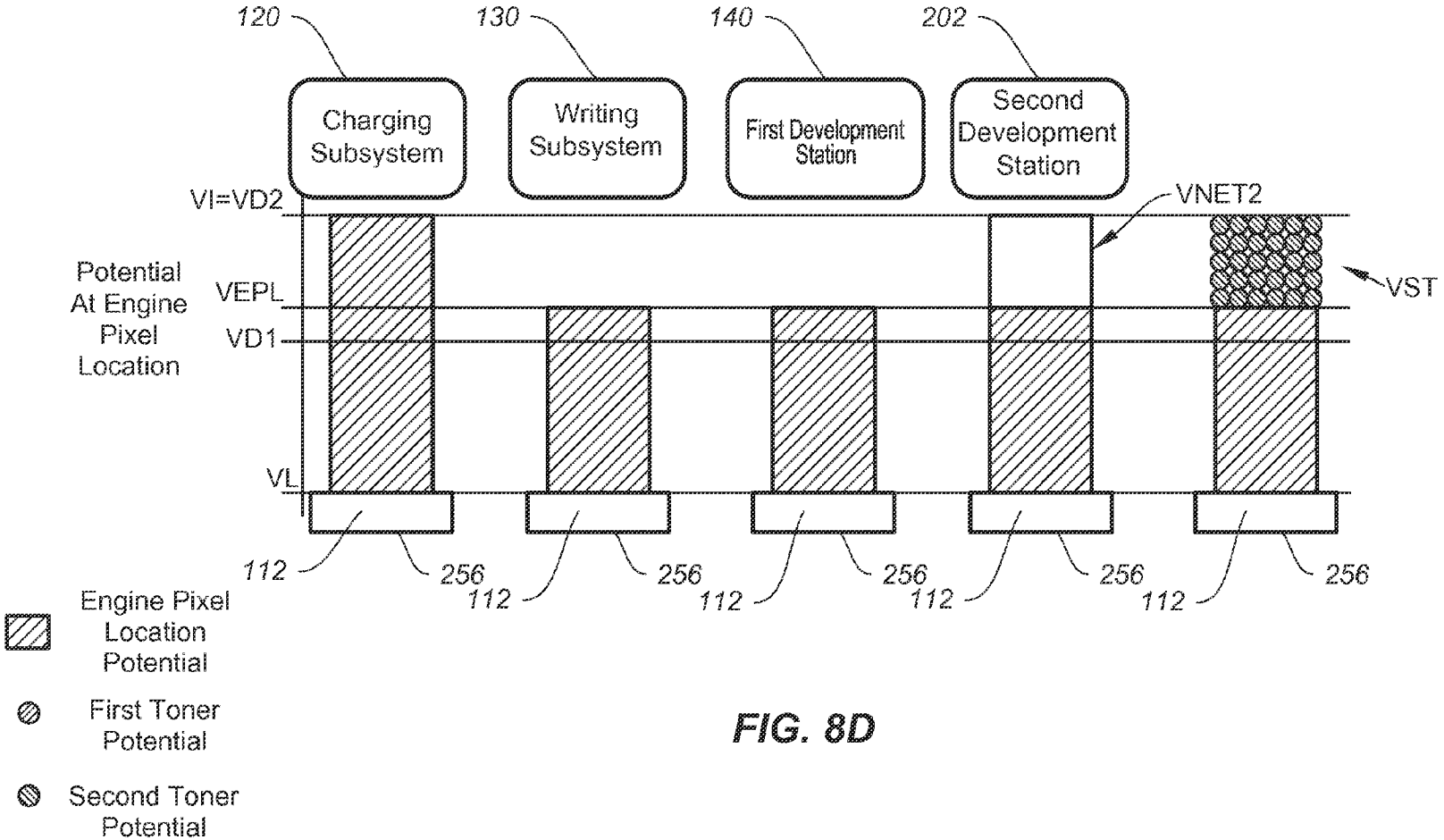

Further, as is shown in FIG. 8D, when an ratio modulated difference of potential VEPL that is within second range 196 is provided at an engine pixel location 256 there is no net first development potential VNET1 and no first toner 158 is developed. However, there is a second net development difference of potential VNET2 that is determined according to the difference between the second development difference of potential VD2 and the ratio modulated difference of potential at engine pixel location 256. This allows a range of ratio modulated development of second toner 208 when the ratio modulated difference of potential VEPL at an engine pixel location 256 is between the first development difference of potential VD1 and the second development difference of potential VD2.

As is discussed generally above, development efficiencies that are less than unity can cause the amount of first toner 158 developed at an engine pixel location to have a first toner potential VFT that is less than a first net development difference of potential VNET1 present during development of the first toner 158. Similarly, development efficiencies that are less than unity can also cause the amount of second toner 208 developed at an engine pixel location to have a second toner potential VST that is less than a net second toner difference of potential VNET2 present during development of the second toner 208. To the extent that such development efficiencies create deviations that occur in a predictable manner, the effects of such development efficiencies can be considered in processes of determining the amounts of first toner 158 that will develop in response to a first net development difference of potential and the amounts of second toner 208 that will develop in response to a second net development difference of potential, the determined range of ratio modulated differences of potential or for any other purpose described herein.

FIG. 9 provides one model of a toner delivery curve for toner amounts that could be provided in response to a single difference of potential at an engine pixel location in accordance with the methods and apparatuses described herein. As can be seen in FIG. 9, three ranges of outcomes are possible. When the difference of potential at the engine pixel location is in range A no first toner 158 or second toner 208 would be deposited on the primary imaging member, while an engine pixel having a difference of potential in range B would allow second toner 208 to deposited in an amount that monotonically increases with increasing differences of potential up to a fixed amount determined by the difference between the second development difference of potential VD2 and the first development difference of potential VD1.

However, when the difference of potential at an engine pixel location is within range C the difference of potential is less than first development difference of potential VD1 so that the fixed amount of second toner 208 is deposited on the primary imaging member along with at least some first toner 158 is also deposited on the primary imaging member. At all ratio modulated differences of potentials within range C, the amount of second toner 208 remains at the fixed amount while first toner 158 is deposited in an amount that that monotonically increases with increasing difference of potential between VD1 and the difference of potential at the engine pixel location. Thus, when a difference of potentials at an engine pixel location is within range C, a ratio controlled combination of a fixed amount of second toner 208 in combination with any of a variable range of amounts of first toner 158 (range C) can be established.

Thus, by defining ratio modulated differences of potential in range C, it becomes possible to achieve ratio controlled applications of two toners on a single primary imaging member and in response to only one ratio modulated difference of potential.

It will be appreciated that this enables a number of different types of toner to be combined without requiring the use of multiple different primary imaging members or multiple passes of a primary imaging member past a development station and writing station.

For example, the methods described herein enable uniquely controllable ratios of a first toner and a second toner 208 to be created at a single imaging member. Such functionality can be used to provide controllable color combinations to be achieved such as combining a first toner having a first hue with a second toner having a second hue, or a first toner having a first transmission density with a second toner having a second different transmission density. Similarly, reflection characteristics can be adjusted, such as by providing different ratios of a high viscosity toner and a low viscosity toner at different engine pixel locations to create selectable gloss levels or such as by creating a combination of a first toner and a second toner in ratios that create different pearlescense qualities. In another example, one toner can be used to provide thin layer of a high glass transition clear toner can be deposited on top of a marking toner. Normally such a clear toner would have difficulty fusing. However, in this embodiment, the presence of the lower glass transition marking toner serves as an adhesive to bond the clear toner. The clear toner then serves to minimize bricking.

Other effects that can be made possible using a controlled combination of toners include incorporating a hue or metallic sheen to the image, tapering high density areas with clear to reduce relief, applying raised letter printing or selectively providing high density toner lay down at particular locations. Document authentication features can also be provided using combinations of controlled ratios of a first toner 158 and a second toner 208. Such toners can have customized materials or characteristics or the existence of a pattern of one or more controlled combinations of conventional toners can be used for authentication purposes.

Functional effects can also be created using these methods with, for example combinations of a first toner and a second toner being provided to form for example and without limitation toner regions having different mechanical, thermal, acoustical, biological, electrical, magnetic or optical properties that can be created by controlled combinations of a first toner 158 and a second toner 208 in different ratios.

The invention has been described in detail with particular reference to certain preferred embodiments thereof, but it will be understood that variations and modifications can be effected within the spirit and scope of the invention.

What is claimed is:

1. A method for printing, the method comprising:

providing a primary imaging member having individual engine pixel locations with a range of ratio modulated differences of potential of a first polarity at each individual engine pixel location;

establishing a first development difference of potential relative to a ground, to form a first net development difference of potential between the first development difference of potential and the ratio modulated difference of potential at the individual engine pixel locations;

providing a first charged toner of the first polarity such that the first toner develops at the individual engine pixel locations according to the first net development difference of potential at the individual engine pixel locations;

establishing a second development difference of potential relative to ground that is greater than the first development difference of potential proximate the individual engine pixel location to form, a second net development difference of potential between the second development difference of potential, the first development difference of potential at the individual engine pixel location and the ratio modulated difference of potential at the individual engine pixel location; and providing a second charged toner having a polarity that is the same as a polarity of the first charged toner such that the second toner develops at the individual engine pixel location according to the second net development difference of potential;

wherein an amount of first toner that can be developed at an individual engine pixel location is within a range of ratio modulated differences of potential, and wherein the second development difference of potential is determined such that an amount of second toner developed with the first toner at an individual engine pixel location in response to a ratio modulated difference of potential allows any of a determined range of ratios of first toner amounts and second toner amounts to be provided at the individual engine pixel locations.

2. The method of claim 1, wherein the first toner comprises a plurality of different toner particles.

3. The method of claim 1, wherein the second toner is clear when fused and the first toner is not clear.

4. The method of claim 1, wherein the second toner has toner particles that have a diameter that is different than toner particles of the first toner.

5. The method of claim 1, wherein the second toner has toner particles that are formed from a different material composition than toner particles in the first toner.

6. The method of claim 1, wherein the second toner has a different glass transition temperature than the first toner.

7. The method of claim 1, wherein the second toner has a lower glass transition temperature than the first toner.

8. The method of claim 1 further comprising the step of transferring the first toner and the second toner onto an intermediate transfer member and then transferring the first toner and the second toner from the intermediate transfer member onto a receiver.

9. The method of claim 1, wherein the first toner, the second toner and the primary imaging member are negatively charged.

10. The method of claim 1, wherein a difference of potential between the second development difference of potential and the first development difference of potential is at least 25 percent of the first development potential.

11. The method of claim 1, wherein selected individual engine pixel locations on the primary imaging member are charged by creating an initial difference of potential relative to ground at the individual engine pixel locations on a photoreceptor of the primary imaging member and exposing the engine pixel locations to light to discharge individual engine pixel locations to an extent that is generally proportional to density information in an image being printed while leaving other individual engine pixel locations at the initial difference of potential.

12. The method of claim 11, wherein the second development difference of potential is greater than the initial difference of potential such that second toner is applied to individual engine pixel locations on which no first toner is recorded according to the difference of potential between the second development difference of potential and the initial difference of potential.

13. The method of claim 1, wherein the first toner comprises a toner of a first color having a first hue and wherein the second toner comprises a toner having the first color and a second different hue.

14. The method of claim 1, wherein the first toner comprises a toner of a first viscosity and the second toner comprises a toner of a second viscosity that is different from the first viscosity.

15. The method of claim 1, wherein the first toner has first color characteristics and the second toner has different second color characteristics.

16. The method of claim 1, wherein individual engine pixel locations that are to have a first toner without the second toner are charged with a difference of potential at or less than the first development difference of potential.

17. The method of claim 1, wherein individual engine pixel locations that are to have a first toner without the second toner developed thereon are positioned so that the first toner will be transferred onto a receiver at locations that correspond to locations where other toners are provided when all the toner forming the image has been transferred to the receiver.

18. The method of claim 1, wherein electrostatic forces that urge transfer of an amount of the second toner to an individual engine pixel location automatically register the second toner with the individual engine pixel location.

19. The method of claim 1, wherein a first portion of the amount of second toner that develops at an individual engine pixel location having first toner is in an amount that develops according to a difference of potential between the first development difference of potential and the second development difference of potential, and a second portion that develops at the individual engine pixel location is an amount according to a difference of potential between the first development differences of potential and the first toner difference of potential at the individual engine pixel location.

20. The method of claim 1, wherein the first toner and second toner are combined in different ratios to provide different mechanical, electrical, magnetic or optical characteristics in different portions of an image.

21. The method of claim 1, wherein the first toner and second toner are combined in different ratios in different portions of the image to provide authentication features in an image that is printed.

22. The method of claim 1, wherein one of the first toner and the second toner has a higher glass transition temperature than the other toner and the ratio of first toner to second toner is determined to allow the lower glass transition temperature toner to help fuse the higher glass transition temperature toner.

23. The method of claim 1, wherein the ratio of the first toner and the second toner is selected to provide a pearlescent effect.

* * * * *